US007633361B2

(12) United States Patent
Raklyar et al.

(10) Patent No.: US 7,633,361 B2
(45) Date of Patent: Dec. 15, 2009

(54) ELECTROMECHANICAL RADIO FREQUENCY SWITCH

(75) Inventors: Aron Raklyar, Brooklyn, NY (US); Gennady Simkin, Brooklyn, NY (US); Efim Polishchuk, Brooklyn, NY (US); Alexsander Meisarosh, Brooklyn, NY (US)

(73) Assignee: Scientific Components Corporation, Brooklyn, NY (US)

( * ) Notice: Subject to any disclaimer, the term of this patent is extended or adjusted under 35 U.S.C. 154(b) by 0 days.

(21) Appl. No.: 12/322,142

(22) Filed: Jan. 28, 2009

(65) Prior Publication Data

US 2009/0160585 A1 Jun. 25, 2009

Related U.S. Application Data

(63) Continuation-in-part of application No. 11/207,025, filed on Aug. 19, 2005, now abandoned.

(51) Int. Cl.
*H01H 53/00* (2006.01)

(52) U.S. Cl. ..... 335/4; 335/5; 335/83; 335/105; 335/133; 335/156; 335/196; 200/504; 200/16 R

(58) Field of Classification Search ..... 335/4–5, 335/83, 105, 133, 156, 196; 200/504, 16 R
See application file for complete search history.

(56) References Cited

U.S. PATENT DOCUMENTS

| | | | |
|---|---|---|---|
| 4,298,847 | A | 11/1981 | Hoffman |
| 4,697,056 | A | 9/1987 | Hoffman |
| 4,908,588 | A | 3/1990 | Hoffman et al. |
| 5,272,458 | A | 12/1993 | Hoffman |
| 5,499,006 | A | 3/1996 | Engel et al. |
| 5,642,086 | A | 6/1997 | Nelson |
| 5,652,558 | A | 7/1997 | Leikus et al. |
| 5,699,030 | A | 12/1997 | Leikus et al. |
| 5,724,014 | A | 3/1998 | Leikus et al. |
| 5,748,055 | A | 5/1998 | Ors |
| 5,815,049 | A | 9/1998 | Cappelli |
| 5,815,057 | A | 9/1998 | Hoffman et al. |
| 5,894,255 | A | 4/1999 | Wallintin |
| 5,973,577 | A | 10/1999 | Karlsson |
| 6,037,849 | A | 3/2000 | Ciezarek |
| 6,043,440 | A | 3/2000 | Sun et al. |
| 6,124,771 | A | 9/2000 | Kim et al. |
| 6,133,812 | A | 10/2000 | Magda |
| 6,204,740 | B1 | 3/2001 | Nakahata |

(Continued)

*Primary Examiner*—Elvin G Enad
*Assistant Examiner*—Mohamad A Musleh
(74) *Attorney, Agent, or Firm*—Siegmar Silber, Esq.

(57) ABSTRACT

An improved electromechanical RF switch provides enhanced reliability and lifespan by incorporating a middle plate between the case and base elements for locating the guide pins, reed holders and reeds to increase accuracy in critical component alignment. The middle plate reduces required precision during assembly of the switch, thus increasing assembly accuracy while reducing labor cost. The guide pins are made of a hard insulator such as glass to generate less wear particles, and the reed holder has a groove filled with lubricant to trap any wear particles that result from sliding friction during switch operation. Optionally, a low-friction bushing is used within the case bore to further reduce sliding friction during reed holder travel. The reeds are made of thin, flexible metal and have ends shaped so that when the ends contact switching terminals, a wiping action removes any surface contamination from both the reed ends and the terminals.

24 Claims, 8 Drawing Sheets

U.S. PATENT DOCUMENTS 6,211,756 B1 4/2001 Sun et al.
6,337,612 B1 1/2002 Kim et al.
6,340,923 B1 1/2002 Yamanaka et al.
6,414,577 B1 7/2002 Hoffman
6,650,210 B1 * 11/2003 Raklyar et al. ..... 335/4

* cited by examiner

ELECTROMECHANICAL RADIO FREQUENCY SWITCH

CROSS-REFERENCES TO RELATED APPLICATIONS

This application is a continuation-in-part of U.S. patent application entitled ELECTROMECHANICAL RADIO FREQUENCY SWITCH, Ser. No. 11/207,025 filed Aug. 19, 2005 now abandoned.

BACKGROUND OF THE INVENTION

1. Field of the Invention

This invention relates to electromechanical relays for switching high-frequency signals with high reliability, long service life, stable insertion loss, stable return loss and high isolation.

2. Description of the Prior Art

Many different types of switches are known for the switching of radio frequency signals. Two main varieties of radio frequency switches are known as reflective switches and absorptive switches, wherein a reflective switch provides an open circuit termination at the output "off" port or terminal and an absorptive switch provides a 50-ohm termination at the output port or terminal. The ideal choice of switch type depends on the application. Radio frequency switches, as with other types of electrical switches, are made in configurations including but not limited to single pole double throw, single pole triple throw, single pole sextuple throw and matrix or transfer type switches. An example of a matrix or transfer type switch is shown in U.S. Pat. No. 4,908,588.

For actual switching function, the switch mechanisms include spring actuated contacts, electromagnetic actuators, plungers with permanent magnets, articulated joints and other movable elements. Examples of these types of switches and switching mechanisms are shown in U.S. Pat. Nos. 6,414,577, 6,340,923, 6,337,612, 6,211,756, 6,204,740, 6,124,771, 5,894,255, 5,815,049, 5,724,014, 5,699,030, 5,652,558, 5,499,006 and 5,272,458. Unfortunately, these switches suffer from poor reliability and low switch lifetime.

Other examples of radio frequency (RF) switches are shown in U.S. Pat. Nos. 6,133,812, 6,037,849, 4,908,588, 4,697,056 and 4,298,847. The RF switches shown in these patents use multiple cylindrical guide pins to guide the reed conductors in an up and down motion while preventing contact between the reed conductors and the walls of the surrounding RF channel.

Guide pin wear, resulting in debris generation and undesirable reed movement, is known to be a major source of performance degradation and operational failure in RF switches and limits the working cycle life of the switch. One method to reduce wear of the guide pins is to increase the contact area between the guide pins and the conductor reeds. This method is illustrated in U.S. Pat. Nos. 5,815,057 and 5,642,086. Another RF switch with increased guide pin contact area is shown in U.S. Pat. No. 6,650,210. The guide element taught therein is generally U-shaped and made from a low-friction polymer material to increase the contact area without increasing sliding friction. However, in the construction of this switch the location of the conductor reeds is controlled by features formed in a case portion of the switch body, while the location of the guide elements is controlled by features formed in a base portion of the switch body. Having elements that need to work together precisely being dimensionally controlled from separate components of the switch decreases accuracy and is likely to result in uneven wear during use. Accurate assembly is thus made more difficult and time-consuming as well. Additionally, even if perfect alignment is achieved this configuration still generates wear debris that will limit the working life of the switch. Another limit on switch cycle life is a buildup of oxides and other contaminants on switch contact surfaces, preventing reliable conduction. There is a continuing need for an RF switch that combines a high lifetime and high reliability with precision movement and ease of assembly in order to overcome the deficiencies of the prior art.

SUMMARY

The improved electromechanical RF switch described herein provides enhanced reliability and switching operation for several million cycles by incorporating a middle plate between the case and base elements. The guide pins are mounted in the middle plate and the reed holders and reeds are positioned via this middle plate to increase accuracy in critical component alignment. The use of this middle plate also requires less precision during assembly of the switch, thus increasing assembly accuracy while reducing labor cost. The guide pins are made of a hard insulative material such as glass that will generate less wear particles than a softer polymer material, and the reed holder has a radial groove filled with lubricant in order to trap any wear particles that do result from sliding friction during switch operation. Optionally, a low-friction bushing may be used within the case bore to further reduce sliding friction during reed holder travel. The reeds are made of thin and flexible metal and have shaped ends so that when the ends contact switching terminals, there is a wiping action to remove any surface oxides or other undesirable insulation from both the reed ends and the terminals.

OBJECTS AND FEATURES OF THE INVENTION

It is an object of the invention to provide a high-reliability electromechanical relay with long cycle life for switching high-frequency signals.

It is a feature of the invention to have a case, a middle plate and a base, the middle plate containing the mounting and alignment holes for switch elements having critical alignment requirements.

It is another feature of the invention to have guide pins mounted in a middle plate in order to more accurately align the guide pins.

It is a yet another feature of the invention to have guide pins made of a hard insulative material such as glass.

It is still another feature of the invention to have a flexible conductive reed mounted on a reed holder, wherein the reed holder is aligned by a hole in a middle plate.

It is further feature of the invention to have a reed holder including a groove filled with lubricant in order to provide lower friction travel and to capture particulate debris to increase operating life.

It is still a further feature of the invention to have a pocket formed between a case bore and a middle plate, adjacent the reed holder, in order to capture particulate debris to increase operating life.

It is an additional feature of the invention to have a low-friction bushing mounted within a case bore to further reduce reed holder sliding friction and increase operating life.

It is another additional feature of the invention to have shaped ends on a flexible conductive reed in order to produce a wiping action during contact with switch terminals and thus remove any surface oxides or other insulating material.

BRIEF DESCRIPTION OF THE DRAWINGS

It is noted that in the Figures, the drawings of the invention are not to scale. In the Figures, like numbering represents like elements between the Figures.

DESCRIPTION OF THE PREFERRED EMBODIMENT AND BEST MODE

Figure 1:
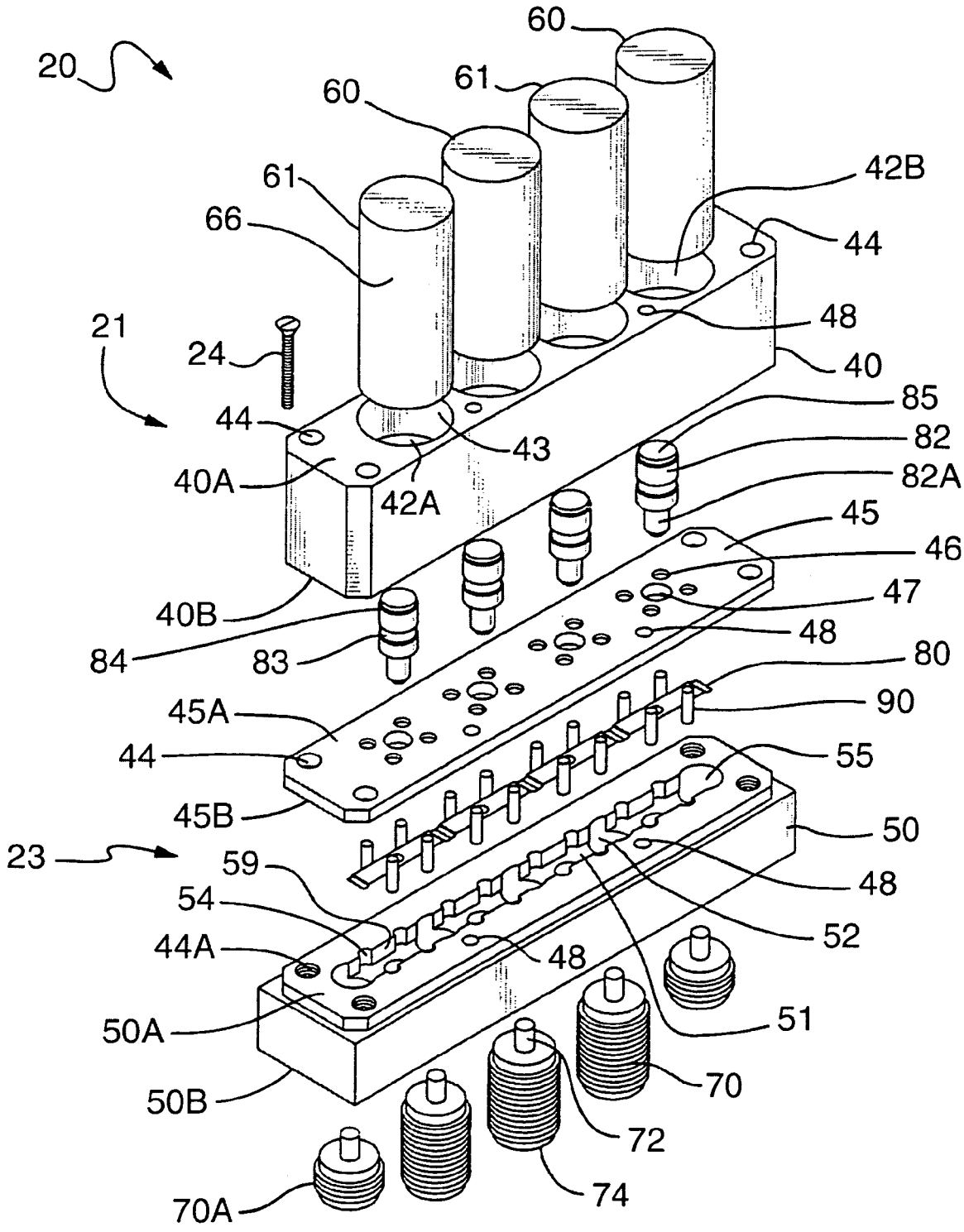
FIG. 1 is an exploded perspective view of an embodiment of a single pole double throw absorptive electromagnetic switch.
Figure 2:
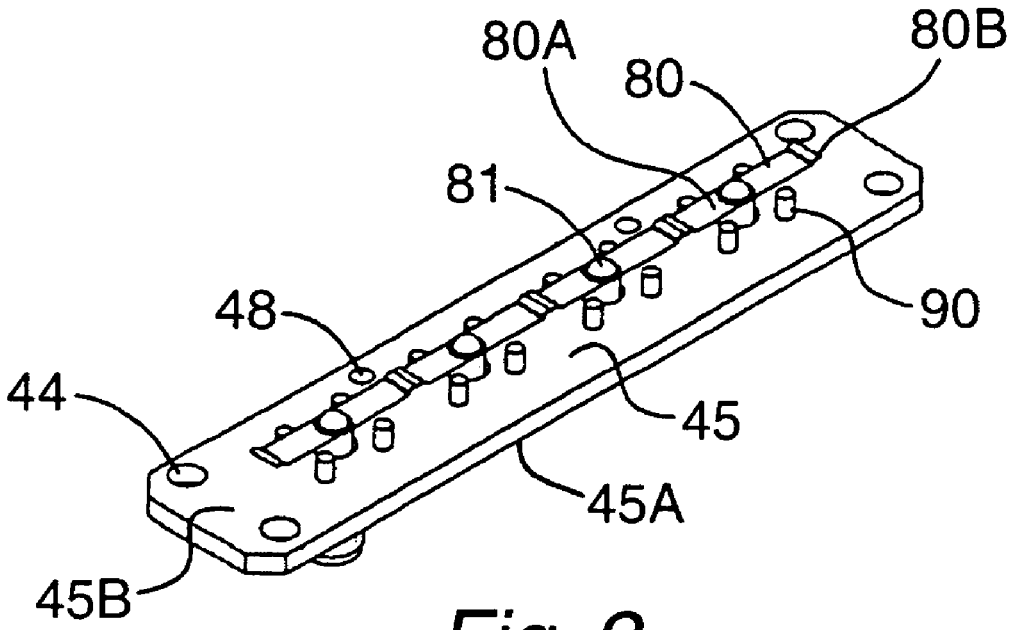
FIG. 2 is an enlarged bottom perspective view of the middle plate assembly of FIG. 1.
Figure 3:
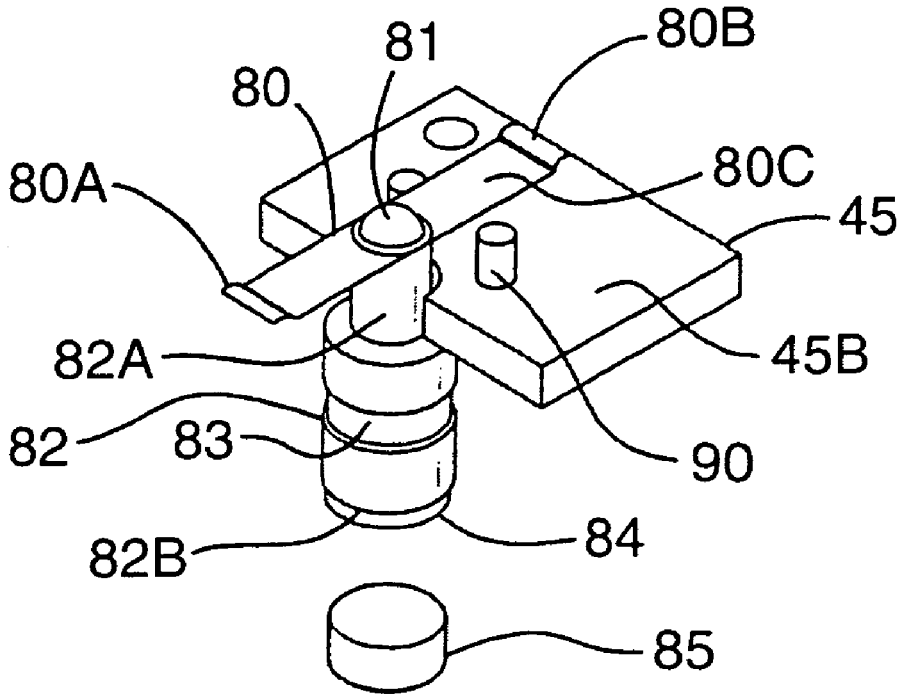
FIG. 3 is a partial cutout view of FIG. 2.

Referring to FIGS. 1-4*a*, a single pole double throw radio frequency absorptive switch assembly 20 is shown. Switch 20 has an actuator sub-assembly 21 and a housing 23. The housing 23 includes middle plate 45 and base 50. Middle plate 45 is located between case 40 and base 50. Screws or bolts 24 mounted in holes 44 and threaded holes 44A hold the switch assembly 20 together.

The actuator subassembly 21 includes a case 40 and actuators 60 and 61. Case 40 has a top surface 40A and a bottom surface 40B. Case 40 has four bores 42B with counterbores 42A that extend through case 40. Bores 42B define a bore wall 43. Screw holes 44 extend through case 40 for screws 24. Alignment dowel holes 48 are also located in case 40, middle plate 45 and base 50.

An actuator 60, preferably a solenoid or electromagnet, is mounted in two of counterbores 42A. An actuator 61, preferably a solenoid or electromagnet, is mounted in two other of counterbores 42A. Actuators 60 and 61 each have a ferromagnetic core 62 that is wound with wires to form coils or windings 64. Core 62 and windings 64 are mounted inside a hollow case or tube 66. Actuators 60 have a lower cavity 67 in core 62 that contains a fixed permanent magnet 68. Actuators 61 do not have a lower cavity 67 or magnet 68. The windings 64 are connected with a switchable source of electricity (not shown). The windings 64 of electromagnet 60 are wound so that the polarity of the generated magnetic field, when electricity is connected, is opposite that of the permanent magnet 68. When the electromagnet 60 is energized the magnetic field of the permanent magnet 68 is overcome by the magnetic field of the electromagnet 60. The polarities of actuators 60 and 61 when energized are opposite to each other.

Middle plate 45 has a top surface 45A, a bottom surface 45B, guide pin holes 46, reed holder holes 47, dowel holes 48 and screw holes 44. All of these holes are through holes in the middle plate 45. The use of a separate middle plate 45 allows for more precise alignment of guide pin holes 46 and reed holder holes 47. The making of precise through holes is also easier to accomplish than the making of precise blind holes, which would be necessary in order to mount the guide pins 90 in the case 40 or the base 50. Blind holes have the additional constraint of bottom depth accuracy, while in contrast it is easier to precisely control the thickness of the middle plate 45 for hole depth, and backing a through hole with a flat surface from a portion of the case 40 or base 50 yields a more precise assembly made from simpler components. The mounting of the reed holder 82, reed 80 and guide pins 90 in a single precisely machined part greatly increases alignment precision and thus further reduces component wear and consequent wear debris.

Base 50 has a path or RF channel 51 that is precision machined and sealed against electromagnetic interference. Base 50 has a top surface 50A and a bottom surface 50B. A slot 52 is located in top surface 50A. Walls 59 define slot 52. Recesses 54 are located in walls 59. Five terminal holes 55 are shown in FIG. 1 and extend from the bottom surface 50B to the bottom of slot 52. Dowel holes 48 are located in base 50. Two dowel holes 48 are used during assembly to align case 40, middle plate 45 and base 50. Alignment dowels (not shown) are inserted through the holes 48 in order to align the case 40 and housing parts and greatly simplify assembly. Four threaded holes 44A extend into base 50. Terminals 70 are affixed in terminal holes 55, preferably by threading although press-fitting is also acceptable. Terminals 70 are preferably of coaxial types including a 50 ohm or other specific impedance coaxial SMA connector, or TNC-type or type N radio frequency connectors. Terminals 70 have a contact tip 72 and a connector end 74. Contact tip 72 extends into slot 52 and is preferably gold-plated. For absorptive switches, terminations are used with a resistance equal to the impedance of terminals 70. Terminals 70A provide a 50 ohm termination for the "off" terminals 70 of the absorptive type switch 20.

Figure 9:
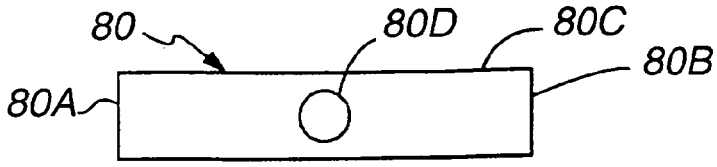
FIG. 9 is a top view of a reed for a single pole double throw switch.
Figure 10:
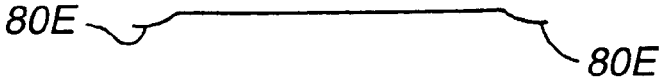
FIG. 10 is a side view of FIG. 9.

Referring also to FIGS. 9 and 10, four electrically conductive reeds 80 are located in slot 52. Reeds 80 have ends 80A, 80B, a center portion 80C and a hole 80D. Reeds 80 are preferably made from a non-magnetic metal. Reeds 80 can be made from a gold alloy that contains gold, platinum, silver and copper. Reeds 80 can also be made from other combinations of materials such as gold plated beryllium copper.

Each of the connector reeds 80 is connected with a dielectric reed holder 82. Reed holder 82 is preferably formed from polychlorotrifluoroethylene (PCTFE) material or another low-friction dielectric material. Reed holder 82 has a first end 82A and a second end 82B and a center groove 83. First end 82A is mounted to the center portion 80C of reed 80 through hole 80D. First end 82A is typically heat staked or ultrasonically staked around hole 80D to form a cap 81 which holds the reed 80 to the reed holder 82. Reed holder second end 82B extends into bore 42B. Reed holder first end 82A extends through hole 47. Center groove 83 is surrounded by bore wall 43. Center groove 83 preferably contains a low temperature lubricant in order to reduce friction between the reed holder 82 and bore 42B. One such lubricant is Amerilube ULT, which is commercially available from the American Synthol, Inc, Marietta, Ga. 30062.

Reed holder 82 slides within bore 42B. Each reed holder end 82B has a cavity 84 that holds a permanent magnet 85.

The polarity of permanent magnets 85 is opposite to the polarity of the other permanent magnets 68 mounted in cavity 67. The reed holders 82 are mounted coaxially to the corresponding axis of counterbores 42A, bores 42B and electromagnets 60 or 61.

A guide member or pin 90 has one end located in guide pin hole 46 and the other end located in recess 54. Reed 80 is located between and aligned by guide pins 90. Four of the guide pins 90 are located around each reed 80. Guide pins 90 are preferably made from hard insulating materials such as glass, sapphire or ceramic. The use of such hard and smooth-surfaced materials greatly reduces generated dust or other debris, while allowing a cylindrical guide element for which it is easier to create an accurately positioned mount. The guide pins 90 allow sliding up and down movement by reed 80 and prevent rotational or sideways movement.

FIGS. 9 and 10 show an enlarged view of reeds 80. Reeds 80 have downwardly extending contact finger portions 80E located on ends 80A and 80B. The contact fingers 80E are slightly rounded. Reeds 80 are able to flex or bend slightly along their length.

During operation, the reeds 80 are moved a relatively small distance by the magnetic attraction or repulsion of electromagnets 60 and 61 to make or break contacts between the terminals 70. The electromagnetic switch device 20 operates in two different modes, de-energized and energized. When electromagnets 60 and 61 are not connected to a power source and thus are in a de-energized condition, two of the reeds 80 will be in contact with the terminals and two will not be in contact. For electromagnets 60, the magnet 85 will be magnetically repulsed from magnet 68. Magnets 68 and 85 are of opposing polarities, resulting in the movement of reed 80 toward terminals 70 to a closed position. For electromagnets 61, the magnet 85 will be magnetically attracted to core 62 resulting in the movement of reed 80 away from terminals 70 to an open position. In the closed position, the ends of reed 80 are on top of contact tips 72 providing an electrical connection between the terminals 70. In the open position, reed 80 will make contact with bottom surface 45B.

When electromagnets 60 and 61 are connected to a power source or activated, two of the reeds 80 will be in contact with the terminals and two will not be in contact. Electromagnets 60 include a multiturn magnet wiring 66A and the magnet 85 is attracted to core 62 when it is energized. This results in the movement of reed 80 away from terminals 70 to an open position. For electromagnets 61, the magnet 85 will be magnetically repulsed from core 62 resulting in the movement of reed 80 toward terminals 70 to a closed position. Electromagnet 61 is strong enough to overcome the attractive force between core 62 and magnet 85 when it is energized.

One of the problems with designing a long life switch is to eliminate any possible dust or contaminants that can come into contact between the reed 80 and the terminal tip 72 and cause an interruption in the electrical path. One source of contamination is the wear between the reed holder 82 and the bore 42B. The use of the center groove 83 traps wear particles and debris generated during operation of the switch. In addition, pockets 49 are created as recesses in case 40. If wear particles are created, they can be collected or trapped in pockets 49. Placing a low temperature lubricant between the reed holder 82 and the bushing 91, particularly in groove 83, reduces friction and reduces the creation of any wear debris or particles. This lubricant can also aid in the trapping of wear particles within pockets 49. Reed holder 83 is also formed with a single cylindrical guiding surface, requiring less precision in manufacturing and assembly than prior art stepped cylinder reed holders.

Another problem with designing a long life switch is to prevent corrosion from building up on the contact surfaces. Even a gold plated surface can have a thin insulative surface film of about 4 Angstroms in thickness that can interfere with making an electrical contact. The use of a flexible reed with contact fingers 80E eliminates the thin surface film. As the contact finger 80E is brought into contact with terminal tip 72, it flexes and wipes both surfaces against each other removing any surface film and providing an electrically stable contact. The reed 80 is formed of a flexible material that can be repeatably bent and will return to its original shape.

Figure 4:
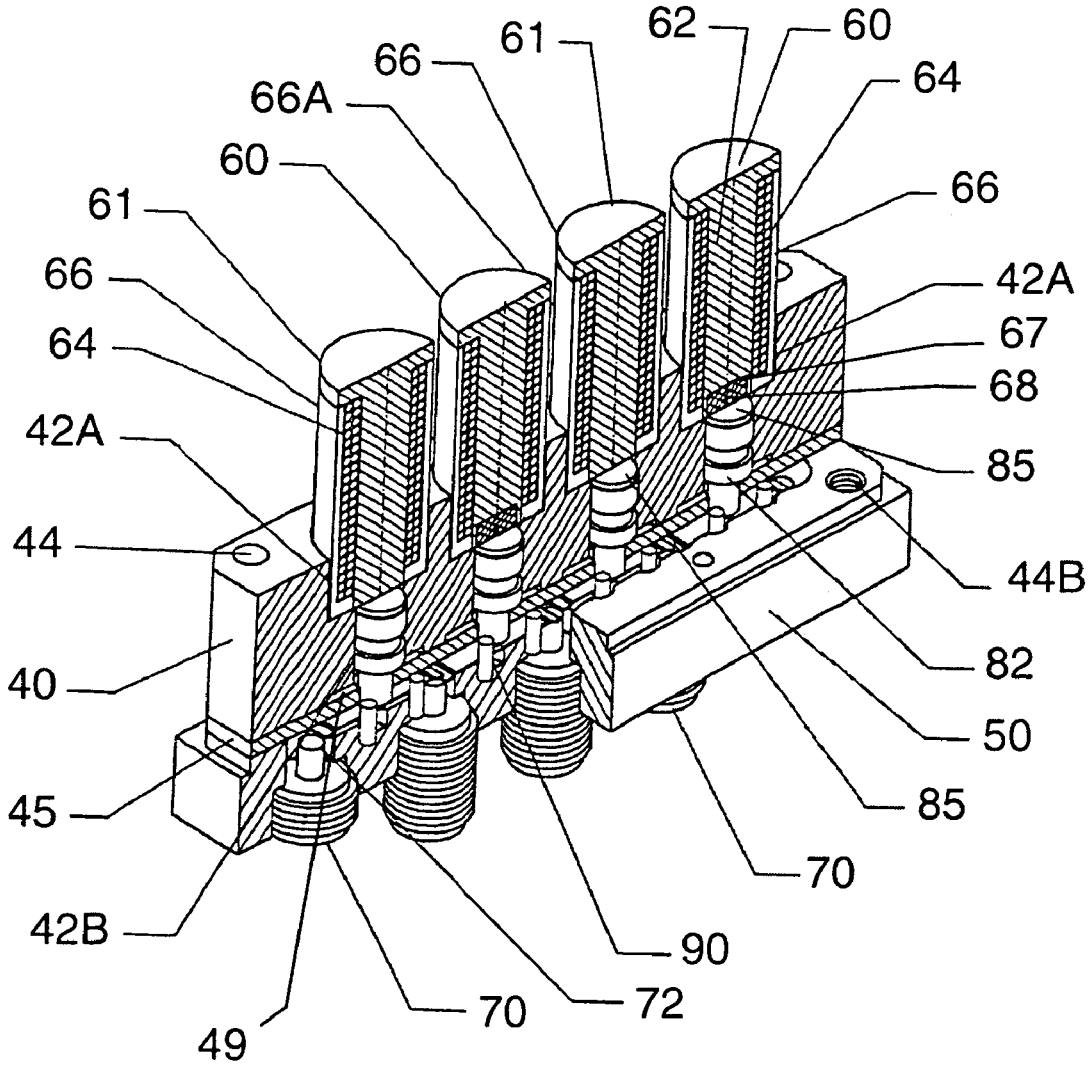
FIG. 4 is a cutaway view of the assembled switch of FIG. 1.
Figure 4A:
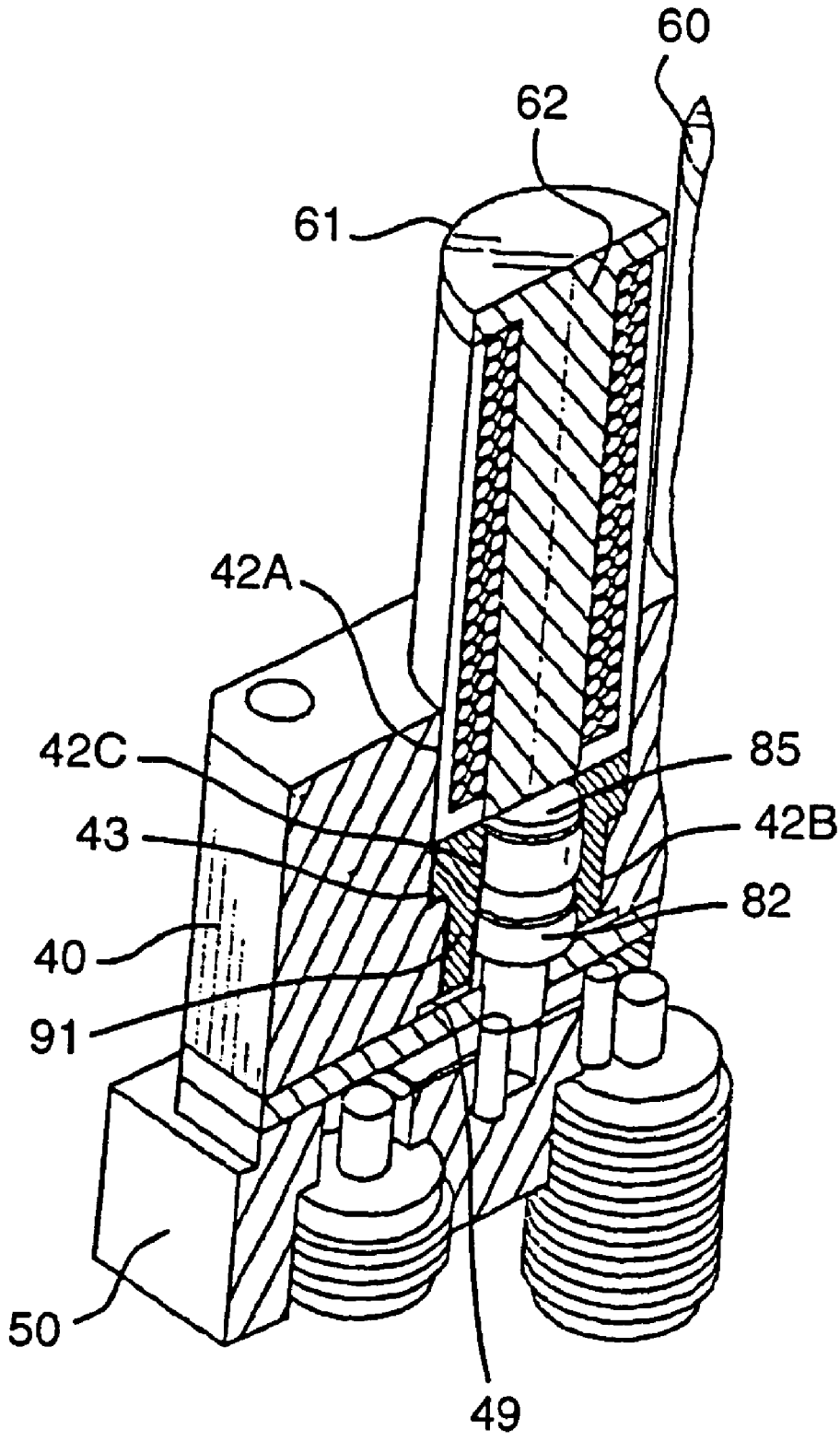
FIG. 4*a* is a partial view of FIG. 4 showing another embodiment that incorporates a sleeve to reduce friction.

Turning now to FIG. 4A, another embodiment of the present invention is shown, wherein a sleeve or bushing 91 has been added to case 40. Sleeve 91 is in contact with bore 42B and can be partially mounted in counterbore 42A. Sleeve 91 is in contact with bore wall 43. Sleeve 91 can be press fit into bore 42B.

Sleeve 91 may be made from a material that has a low coefficient of friction, such as a plastic material. The use of sleeve 91 allows the cover to be made from a wide variety of materials, including lightweight and inexpensive metals such as aluminum. Sleeve 91 reduces friction between bore 42C and reed holder 82. The use of sleeve 91 increases the life of the switch by reducing frictional wear on reed holder 82.

Figure 5:
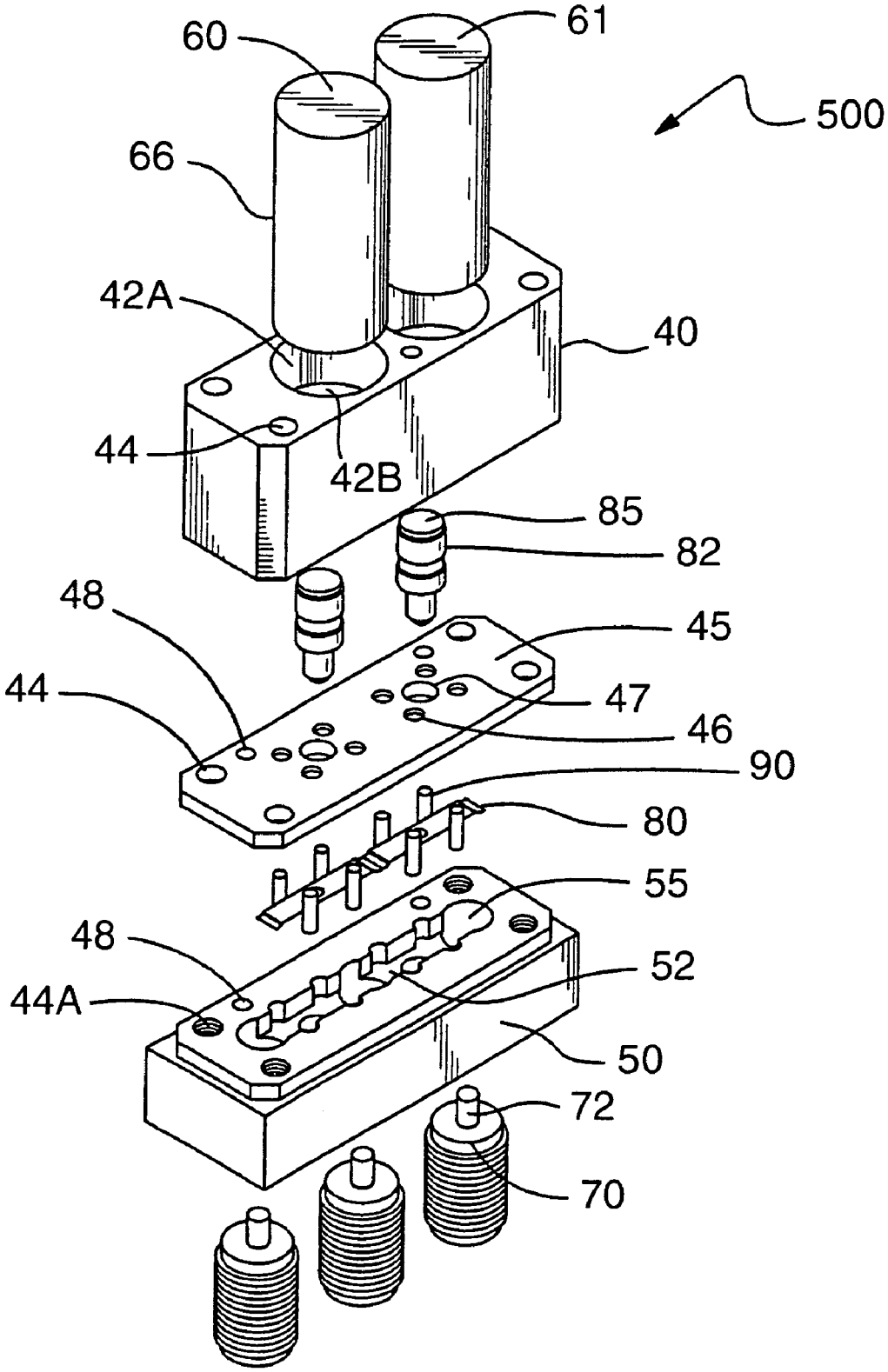
FIG. 5 is an exploded perspective view of another embodiment of a single pole double throw reflective electromagnetic switch.

Referring to FIG. 5, a single pole double throw electromagnetic reflective switch 500 is shown. Switch 500 is similar to switch 20 except that fewer contacts are switched. Switch 500 has three terminals 70 and two reeds 80. The operation of switch 500 is essentially the same as for switch 20.

Figure 6:
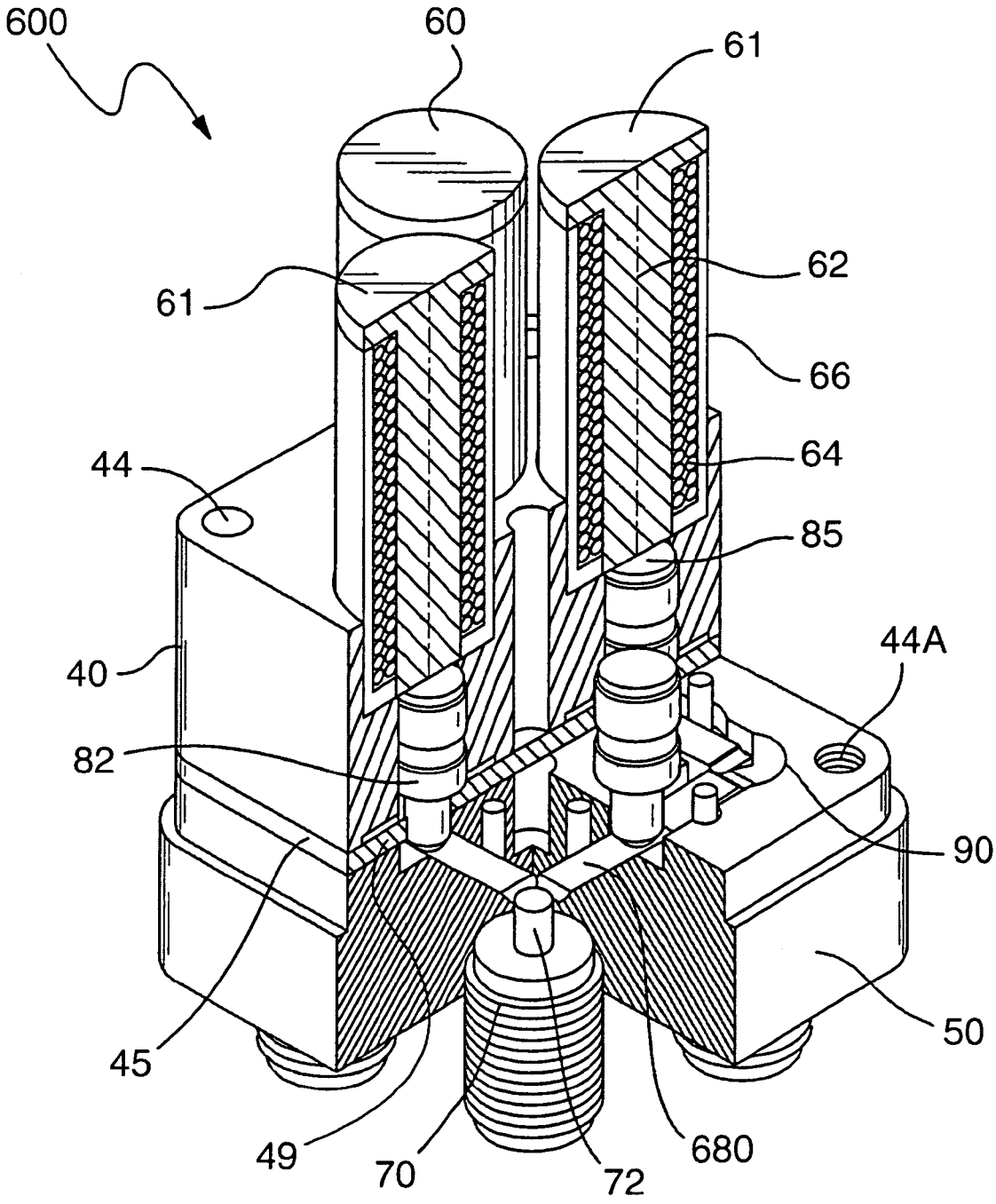
FIG. 6 is a cutaway view of an assembled transfer switch.
Figure 11:
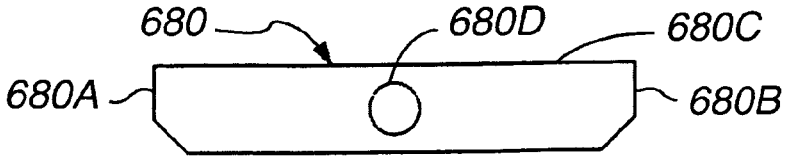
FIG. 11 is a top view of a reed for a transfer switch.
Figure 12:
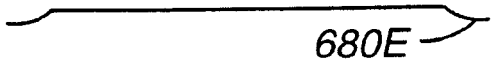
FIG. 12 is a side view of FIG. 11.

Referring to FIGS. 6, 11 and 12 a transfer switch 600 is shown. Switch 600 is similar to switch 20 except that switching can be performed between two signals using four terminals. Switch 600 has four terminals 70 and four reeds 680. FIGS. 11 and 12 show the details of reed 680, which has ends 680A and 680B, a center portion 680C, a hole 680D and contact fingers 680E. The reeds 680 are oriented perpendicularly to each other such that the ends 680A and 680B of two reeds 680 are in contact with each terminal tip 72. The operation of switch 600 is essentially the same as for switch 20.

Figure 7:
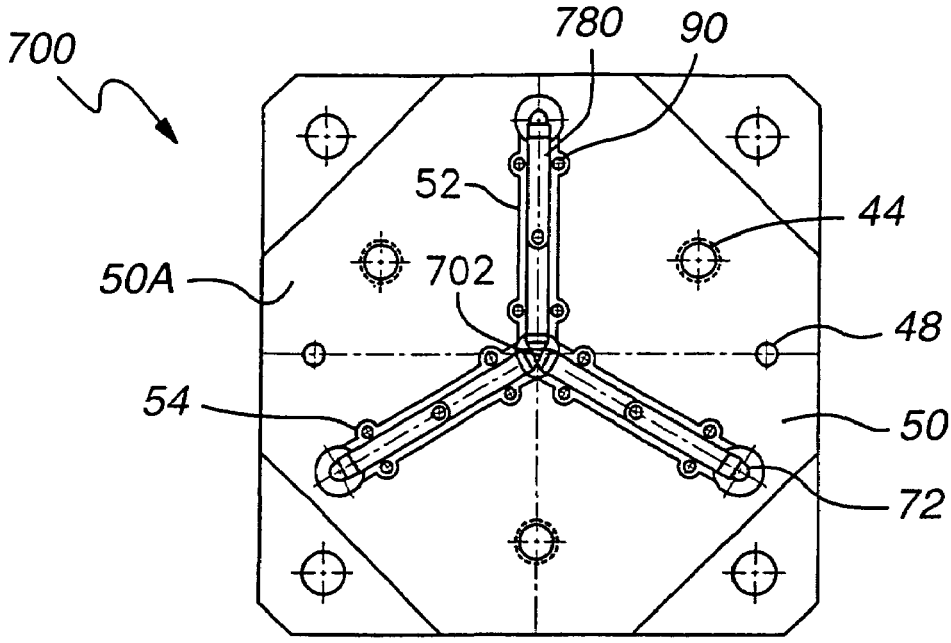
FIG. 7 is a top view showing the guide pins and reeds of a single pole triple throw reflective electromagnetic switch.
Figure 13:
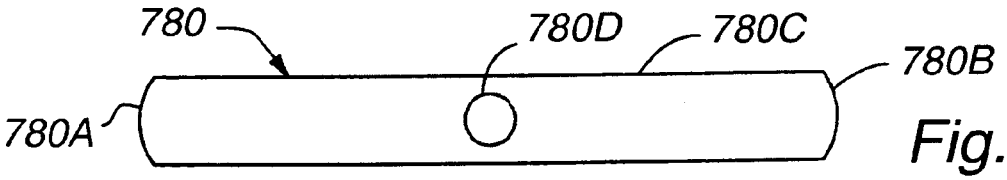
FIG. 13 is a top view of a reed for a single pole triple throw switch.
Figure 14:
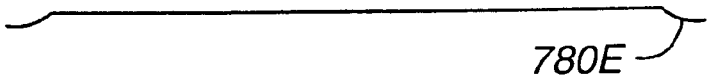
FIG. 14 is a side view of FIG. 13.

Referring to FIGS. 7, 13 and 14 a partial top view of a single pole triple throw reflective switch 700 is shown. Switch 700 is similar to switch 20 except that switching can be performed between three terminals and a common center terminal 702. The reeds 780 are oriented in a Y-shape. FIGS. 13 and 14 show the details of reed 780, which has ends 780A, 780B, a center portion 780C, a hole 780D and contact fingers 780E. Three of the reed ends 780A can contact with the center terminal 702. Reed ends 780B can contact with the other terminals. The operation of switch 700 is essentially the same as for switch 20.

Figure 8:
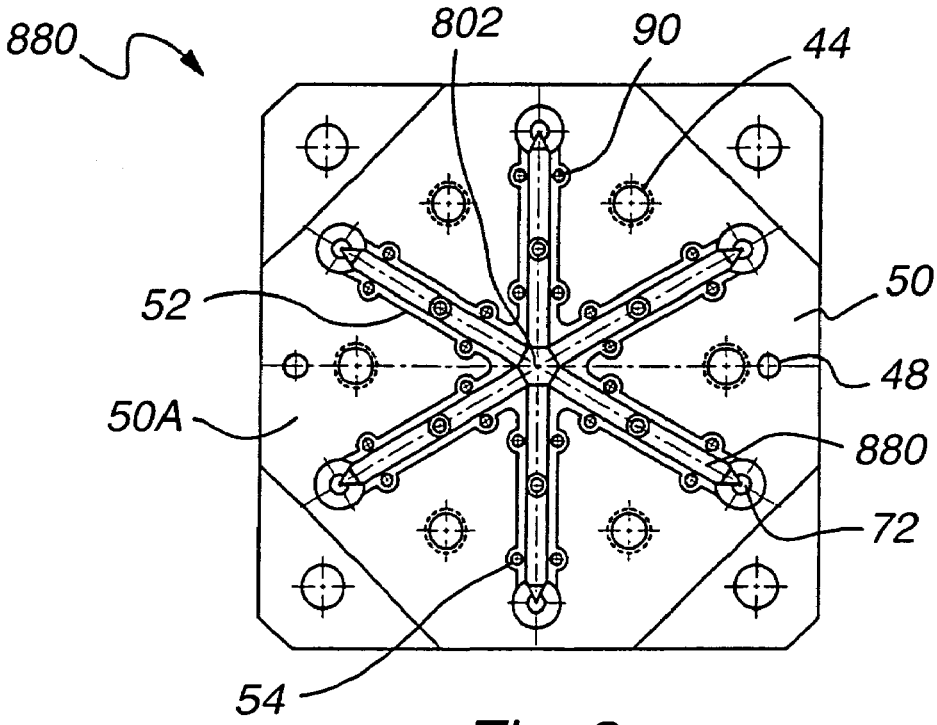
FIG. 8 is a top view showing the guide pins and reeds of a single pole sextuple throw reflective electromagnetic switch.
Figure 15:
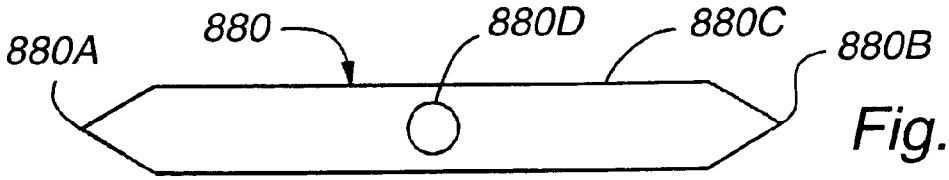
FIG. 15 is a top view of a reed for a single pole sextuple throw switch.
Figure 16:
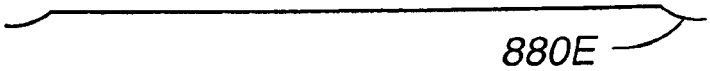
FIG. 16 is a side view of FIG. 15.

Referring to FIGS. 8, 15 and 16 a partial top view of a single pole sextuple throw reflective switch 800 is shown. Switch 800 is similar to switch 20 except that switching can be performed between six terminals and a common center terminal 802. The reeds 880 are oriented in a star pattern around center terminal 802. FIGS. 15 and 16 show the details of reed 880, which has ends 880A, 880B, a center portion 880C, a hole 880D and contact fingers 880E. Six of the reed ends 880A can make contact with the center terminal 802. Ends 880B can make contact with the other terminals. The operation of switch 880 is essentially the same as for switch 20.

A skilled artisan will recognize that variations of the switch assembly 20 are possible. For example, the electromagnets could be arranged differently than was shown, or could have multiple independent coil sections. Permanent magnets 68 could be replaced with compressed springs to move the reed to a closed position. Permanent magnets, springs or other force-inducing elements may also be used to create fail-safe switching actions to open or closed positions or both. Ferromagnetic materials may be used to further control the electromagnetic fields. More or fewer reeds, terminals or electromagnets could be used if desired depending upon the particular switching configuration that is needed. Even though the switching device shown was described for RF signals, switch device 20 could be used for any digital or analog signal from DC to very high frequencies.

Having described herein illustrative embodiments and best mode of the present invention, persons of ordinary skill in the art will appreciate various other features and advantages of the invention apart from those specifically described above. It should therefore be understood that the foregoing is only illustrative of the principles of the invention, and that various modifications and additions can be made by those skilled in the art without departing from the spirit and scope of the invention. Accordingly, the appended claims shall not be limited by the particular features that have been shown and described, but shall be construed also to cover any obvious modifications and equivalents thereof.

What is claimed is:

1. A switch comprising:

a base having at least one slot therein;

a case aligned with said base;

a middle plate with a plurality of holes therethrough disposed between said base and said case;

a first terminal mounted in said base and extending into said slot;

a second terminal mounted in said base and extending into said slot;

a plurality of guide members affixed within said through holes in said middle plate and extending into said slot;

an electrically conductive reed located between said guide members and extending along said slot, said reed movable between a first position in which said first and second terminals are electrically connected and a second position in which said first and second terminals are electrically disconnected;

a reed holder moveable in said case, said reed holder having a first end and a second end, said first end extending through one of said through holes of said middle plate and affixed to said reed;

an actuator mounted in said case and magnetically coupled to said second end of said reed holder, said actuator operable to move said reed between said first and said second position; and, whereby the movement of said reed is constrained by the positioning of at least one of said plurality of said guide members, said reed and said reed holder, said positioning being controlled by the location of said through holes in said middle plate.

2. The switch as described in claim 1, wherein said case has at least one bore extending therethrough and wherein said reed holder has a debris-collecting groove located between said first and second ends thereof.

3. The switch as described in claim 2, wherein said reed holder is mounted in said bore, said debris-collecting groove being surrounded by said bore.

4. The switch as described in claim 3, wherein said debris-collecting groove contains a lubricant, whereby friction is reduced by said lubricant and particulates are entrapped by said lubricant thereby increasing the life of said switch.

5. The switch as described in claim 4, wherein said case contains a pocket bordering said bore and facing said middle plate, said pocket further serving to entrap particulates and thereby increasing the life of said switch.

6. The switch as described in claim 2, wherein said actuator comprises:

a tube partially mounted in said bore;

an electromagnet mounted in said tube;

a first permanent magnet mounted to said second end of said reed holder, said first permanent magnet mounted adjacent said electromagnet, said electromagnet operable to attract and repel said first permanent magnet such that said reed moves between said first and second positions.

7. The switch as described in claim 6, wherein said second end of said reed holder has a cavity, said first permanent magnet mounted in said cavity.

8. The switch as described in claim 6, wherein said electromagnet has a core having a plurality of windings thereon, said windings connectable and disconnectable from a power source; and, said core further having a cavity, a second permanent magnet mounted in said cavity, said second permanent magnet having a polarity opposite that of said first permanent magnet.

9. The switch as described in claim 2, wherein a low-friction sleeve is mounted in said bore.

10. The switch as described in claim 9, wherein said reed holder is mounted in said sleeve.

11. The switch as described in claim 1, wherein said reed has a pair of ends, said ends each having a contact finger extending therefrom, said contact fingers contacting said terminals.

12. A switch assembly comprising:

a housing having a base and a case, said case having at least one bore and said base having at least one slot;

at least one electromagnet mounted in said case;

at least one reed holder having a first end, a second end and a debris-collecting groove, said second end of said reed holder mounted in said bore adjacent said electromagnet, said debris-collecting groove surrounded by said bore;

a first terminal and a second terminal mounted in said base and extending into said slot; and, an electrically conductive reed mounted to said first end of said reed holder and located in said slot, said reed having a first end and a second end, said first end extending over said first terminal and said second end extending over said second terminal, said electromagnet being operable to move said reed holder and said reed between a first position in which said first and second terminals are electrically connected and a second position in which said first and second terminals are electrically disconnected, said debris-collecting groove entrapping particulate debris generated by wear during operation of said switch assembly.

13. The switch assembly as described in claim 12, wherein said first and second ends of said reed each have a flexible contact finger extending therefrom, said contact finger contacting said terminals.

14. The switch assembly as described in claim 13, wherein, as said reed moves between said first and second positions, said contact fingers flexibly wipe against said terminals and remove surface oxides from said contact fingers and said terminals.

15. The switch assembly as described in claim 12, wherein said debris-collecting groove contains a lubricant.

16. The switch assembly as described in claim 12, further comprising:

a middle plate mounted between said case and said base, and having a plurality of through holes between said case and said base;

at least one guide member mounted in one of said through holes;

said reed holder positioned within one of said through holes; and, said slot having at least one recess located on a side of said slot in order to receive said guide member.

17. The switch assembly as described in claim 12, wherein a first permanent magnet is mounted to said second end of said reed holder, said first permanent magnet mounted adjacent said electromagnet, said electromagnet operable to attract and repel said permanent magnet such that said reed moves between said first and second positions.

18. The switch assembly as described in claim 17, wherein said second end of said reed holder has a cavity, said first permanent magnet mounted in said cavity.

19. The switch assembly as described in claim 12, wherein said first end of said reed holder is mounted to the middle of said reed.

20. The switch assembly as described in claim 12, wherein said electromagnet has a core having a plurality of windings thereon, said windings connectable and disconnectable with an electrical power source; and, said core further having a cavity, said cavity having a second permanent magnet mounted therein, said second permanent magnet having a polarity opposite that of said first permanent magnet such that said first and second magnets repel each other.

21. The switch assembly as described in claim 17, wherein the polarity of a magnetic field generated by said electromagnet is opposite that of said first permanent magnet.

22. The switch assembly as described in claim 12, wherein a low-friction sleeve is mounted in said bore.

23. The switch as described in claim 22, wherein said reed holder is mounted in said sleeve.

24. An electromagnetic switch comprising:

a base having a slot therein and a case covering at least a portion of said base, said case having a bore a debris-collecting groove disposed in said bore;

a first terminal mounted in said base and extending into said slot;

a second terminal mounted in said base and extending into said slot;

a reed holder mounted in said bore, said reed holder having a first end and a second end, said second end mounted in said bore;

an electrically conductive reed mounted in said slot, said reed being flexible and having a first end, a second end and a center portion, said first end of said reed holder connected to said center portion of said reed, said first end extending over said first terminal and said second end extending over said second terminal;

a first contact finger extending from said first end of said reed toward said first terminal;

a second contact finger extending from said second end of said reed toward said second terminal;

an actuator mounted in said bore and magnetically coupled to said second end of said reed holder, said actuator operable to move said reed between a first position in which said first and second terminals are electrically connected and a second position in which said first and second terminals are electrically disconnected; and, upon said reed moving between said first and second positions, said contact fingers flexibly wiping against said terminals and removing contaminants present on said contact finger and said terminal.

* * * * *